United States Patent [19]

Nakajima et al.

[11] Patent Number: 4,737,081

[45] Date of Patent: Apr. 12, 1988

[54] VARIABLE CAPACITY VANE COMPRESSOR

[75] Inventors: Nobuyuki Nakajima; Kenichi Inomata; Shigeru Okada, all of Konan, Japan

[73] Assignee: Diesel Kiki Co., Ltd., Japan

[21] Appl. No.: 56,604

[22] Filed: May 29, 1987

[30] Foreign Application Priority Data

Jul. 7, 1986 [JP] Japan ..... 61-159309
Jul. 7, 1986 [JP] Japan ..... 61-159311

[51] Int. Cl.[4] ..... F04B 49/02; F04C 29/08
[52] U.S. Cl. ..... 417/295; 417/310
[58] Field of Search ..... 417/295, 310, 440; 418/15, 78

[56] References Cited

U.S. PATENT DOCUMENTS 4,621,936 11/1986 Sudo ..... 417/310

FOREIGN PATENT DOCUMENTS 174516 3/1986 European Pat. Off. ..... 417/310

*Primary Examiner*—William L. Freeh
*Attorney, Agent, or Firm*—Charles S. McGuire

[57] ABSTRACT

A variable capacity vane compressor has a pressure chamber formed in one of side blocks of a cylinder and communicating a zone under lower pressure with a zone under higher pressure, and at least one second inlet port the opening angle of which is variable in response to a difference between pressure within a first pressure chamber of the pressure chamber and pressure within a second pressure chamber of same. The second pressure chamber is communicated with the zone under higher pressure via a high-pressure communication passage and with the zone under lower pressure via a low-pressure communication passage. A control valve device extends across the high-pressure communication passage and the low-pressure communication passage, and is disposed to close the low-pressure communication passage and simultaneously open the high-pressure communication passage when pressure within the zone under lower pressure exceeds a predetermined value, and to open the low-pressure communication passage and simultaneously effect one of closing and reduction of the opening area of the high-pressure communication passage when the pressure within the zone under lower pressure is below the predetermined value, whereby the capacity of the compressor can be varied with high responsiveness.

10 Claims, 12 Drawing Sheets

VARIABLE CAPACITY VANE COMPRESSOR

BACKGROUND OF THE INVENTION

This invention relates to variable capacity vane compressors which are adapted for use as refrigerant compressors of air conditioners for automotive vehicles.

A variable capacity vane compressor is known e.g. by Japanese Provisional Utility Model Publication No. 55-2000 filed by the same assignee of the present application, which is capable of controlling the capacity of the compressor by varying the suction quantity of a gas to be compressed. According to this known vane compressor, arcuate slots are formed in a peripheral wall of the cylinder and each extend from a lateral side of a refrigerant inlet port formed through the same peripheral wall of the cylinder and also through an end plate of the cylinder, and in which is slidably fitted a throttle plate, wherein the effective circumferential length of the opening of the refrigerant inlet port is varied by displacing the throttle plate relative to the slot so that the compression commencing position in a compression chamber defined in the cylinder and accordingly the compression stroke period varies to thereby vary the capacity or delivery quantity of the compressor. A link member is coupled at one end to the throttle plate via a support shaft secured to the end plate, and at the other end to an actuator so that the link member is pivotally displaced by the actuator to displace the throttle plate.

However, according to the conventional vane compressor, because of the intervention of the link member between driving means or the actuator and a control member or the throttle plate for causing displacement of the throttle plate, the throttle plate undergoes a large hysteresis, leading to low reliability in controlling the compressor capacity, and also the capacity control mechanism using the link member, etc. requires complicated machining and assemblage.

Further, a variable capacity vane compressor which has a reduced hysteresis of the control member is known by Japanese Provisional Patent Publication (Kokai) No. 61-232397 filed by the same assignee of the present application, which provides an improvement in a vane compressor comprising a cylinder formed of a cam ring and a pair of side blocks closing opposite ends of the cam ring, a rotor rotatably received within the cylinder, a plurality of vanes radially slidably fitted in respective slits formed in the rotor, a control member disposed for displacement in a refrigerant inlet port formed in one of the side blocks, and driving means for causing the control member to be displaced relative to the refrigerant inlet port, whereby the capacity or delivery quantity of the compressor can be varied by displacement of the control member. The improvement comprises driven teeth provided on the control member, and driving teeth provided on an output shaft of the driving means in mating engagement with the driven teeth, whereby the control member is driven directly by the driving means through the mating driving and driven teeth.

However, according to this conventional vane compressor, a stepping motor as the driving means is mounted within the compressor housing, requiring a large space for accommodation of the stepping motor, and the capacity control mechanism has an overall complicated construction and accordingly is high in manufacturing cost.

The first-mentioned conventional vane compressor is disposed to vary the circumferential length of the opening of the refrigerant inlet port by displacing the throttle plate relative to the slot, that is, to vary a circumferential angle at which the refrigerant inlet port is closed with respect to the position of the vane, which is hereinafter referred to as "closing angle".

FIG. 1 shows the operating regions which the vane passes to execute one operating cycle of a conventional vane compressor in which the refrigerant inlet port is closed at a fixed angle, and FIG. 2 shows load on the vane with respect to rotational angle of the rotor of the compressor.

In FIG. 1, symble a designates the rotor, b a vane slit radially formed in the rotor a, c a vane slidably fitted in a vane slit b, d a vane back-pressure chamber defined in the rotor a at an inner end of a slit b in the rotor a, e a communication groove formed at an end face of the rotor a such that it arcuately extends through a predetermined angle and is communicated with each vane back-pressure chamber d, f a cam ring, g a refrigerant inlet port formed in a side block h, and i a refrigerant outlet port formed in the cam ring f, respectively. In such vane compressor wherein the regrigerant inlet port is closed at a fixed angle, the fixed angle $\theta$ at which the refrigerant inlet port is closed is, for example, set at approximately 45 degrees in the forward rotational direction of the rotor a from a circumferential location at which a clearance between an outer peripheral surface of the rotor a and the inner peripheral surface of the cam ring f assumes the minimum value. The region extending through approximately 45 degrees corresponds to the suction stroke, i.e. a suction pressure Ps area where the suction pressure is introduced into a compression chamber j. A region extends through 75 degrees in the forward rotational direction of the rotor a from the terminating end of the suction pressure area Pa, which corresponds to the compression stroke, where the pressure within the compression chamber j increases from the suction pressure Ps to a discharge pressure Pd. A region extends through 60 degrees in the forward rotational direction of the rotor a from the terminating end of the compression stroke, which corresponds to the discharge stroke, i.e. a discharge pressure Pd area where the compressed refrigerant is discharged. The circumferential position and circumferential length of the arcuate communication groove e are set such that the outer end of the vane c is always kept in contact with the inner peripheral surface of the cam ring f. Back pressure Pk within each vane back-pressure chamber d is determined by the difference between an amount of refrigerant gas flowing from a high pressure zone or a discharge pressure chamber, not shown, into the vane back-pressure chamber d by way of the communication groove e and one flowing from the vane back-pressure chamber d into a suction chamber, not shown. In FIG. 1, it is clear that the pressure increasing area between the suction pressure Ps area and the discharge pressure area Pd, and the discharge pressure Pd area are larger in total circumferential angle than the suction pressure Ps area as a low pressure area, so that the amount of refrigerant gas flowing from the discharge chamber into the vane back-pressure chamber d is always greater than one flowing from the back-pressure chamber d into the suction chamber. Therefore, the vane back pressure Pk acting on the inner end face of the vane c (the force urging the vane c toward the outer periphery of the rotor a) is always greater than the high pressure acting on the outer end face of the vane c (the force urging the vane c toward the center of the rotor a), which results in that the outer end of the vane c is always kept in contact with the inner peripheral surface of the cam ring f.

On the other hand, in the above-described conventional variable capacity vane compressor, in which the angle at which the refrigerant inlet port is closed or the closing angle is variable, the closing angle is so small during full capacity that the pressure increasing area between the suction pressure Ps area and the discharge pressure Pd area, and the discharge pressure Pd area are larger in total circumferential angle than the suction pressure Ps area, as similarly to the vane compressor of fixed closing angle type as shown in FIG. 1. Thus, there is no problem during the full capacity operation. However, there occurs the following problem during partial capacity operation. During the partial capacity operation, the closing angle $\theta$ of the inlet port g is closed is approximately 100 degrees in the forward rotational direction of the rotor a from the circumferential location at which the clearance between the outer peripheral surface of the rotor a and the inner peripheral surface of the cam ring f is the minimum, as shown in FIG. 3. The region extending through approximately 100 degrees corresponds to the suction stroke, i.e. a suction pressure Ps area where the suction pressure is introduced into a compression chamber j. A region extends through 40 degrees in the forward rotational direction of the rotor a from the terminating end of the suction pressure Ps area, which corresponds to the compression stroke, where the pressure within the compression chamber j increases from the suction pressure Ps to a discharge pressure Pd. A region extends through 40 degrees in the forward rotational direction of the rotor a from the terminating end of the compression stroke, which corresponds to the discharge stroke, i.e. a discharge pressure Pd area where the compressed refrigerant is discharged. The pressure increasing area between the suction pressure Ps area and the discharge pressure area Pd, and the discharge pressure Pd area are smaller in total circumferential angle than the suction pressure Ps area as a low pressure area, so that the amount of refrigerant gas flowing from the back-pressure chamber d into the suction chamber becomes greater than one flowing from the discharge chamber into the vane back-pressure chamber d. Therefore, the vane back pressure Pk acting the inner end face of the vane c becomes smaller than that during the full capacity operation, as shown in FIG. 4. Especially, in the vicinity of the terminating end of the compression stroke, as indicated by simble A in FIG. 4, the vane back pressure Pk acting on the inner end face of the vane c becomes smaller than the high pressure acting on the outer end face of the vane c, which results in that the outer end of the vane c becomes separated from the inner peripheral surface of the cam ring f. In the worst case, the compression is not performed. Further, when the outer end of the vane c becomes separated from the inner peripheral surface of the cam ring f, the vane back pressure Pk acting on the inner end face of the vane c surpasses the discharge pressure Pd acting on the outer end face, wherery the outer end of the vane c is again brought into contact with the inner peripheral surface of the cam ring f. In this way, the outer end of the vane c are alternately brought into or out of contact with the inner peripheral surface of the cam ring f during every one rotation of the rotor a, causing chattering noise.

SUMMARY OF THE INVENTION

It is an object of the invention to provide a variable capacity vane compressor which has a capacity control mechanism which is simple in structure and compact in size, thus facilitating assemblage and requiring a low manufacturing cost, but is capable of controlling the compressor capacity with high reliability.

It is another object of the invention to provide a variable capacity vane compressor which has a capacity control mechanism which varies the capacity of the compressor by varing the closing angle of the refrigerant inlet port, but is free from chattering noise even during partial operation of the compressor.

According to the present invention, there is provided a variable capacity vane compressor comprising: a cylinder formed of a cam ring and a pair of front and rear side blocks closing opposite ends of the cam ring, one of the front and rear side blocks having at least one first inlet port formed therein; a rotor rotatably received within the cylinder; a plurality of vanes radially slidably fitted in respective slits formed in the rotor; a housing accommodating the cylinder and defining a suction chamber and a discharge pressure chamber therein; wherein compression chambers are defined between the cylinder, the rotor and adjacent ones of the vanes and vary in volume with rotation of the rotor for effecting suction of a compression medium from the suction chamber into the compression chambers through the at least one first inlet port, and compression and discharge of the compression medium; at least one second inlet port formed in the one of the front and rear side blocks which has the at least one first inlet port formed therein, the at least one second inlet port being located adjacent a corresponding one of the at least one first inlet port, and communicating the suction chamber with at least one of the compression chambers which is on a suction stroke; a pressure chamber formed in the one of the front and rear side blocks having the at least one first inlet port formed therein, and communicating a zone under lower pressure with a zone under higher pressure, the lower pressure being variable in response to the rotational speed of the compressor; control means for controlling the opening angle of the at least one second inlet port, the control means having a pressure receiving portion slidably fitted in the pressure chamber and dividing the pressure chamber into a first pressure chamber communicating with the zone under lower pressure and a second pressure chamber communicating with both the zone under lower pressure and the zone under higher pressure; the conrol means being angularly displaceable in response to a difference between the first and second pressure chambers for causing the control means to vary the opening angle of the at least one second inlet port, to thereby cause a change in the timing of commencement of the compression of the compression medium and hence vary the capacity of the compressor; a low-pressure communication passage communicating the second pressure chamber with the zone under lower pressure; a high-pressure communication passage communicating the second pressure chamber with the zone under higher pressure; and valve means for selectively opening and closing the low-pressure communication passage and the high-pressure communication passage, the valve means being disposed to close the low-pressure communication passage and simultaneously open the high-pressure communication passage when pressure within the zone under lower pressure exceeds a predetermined value, and to open the low-pressure communication passage and simultaneously effect one of closing and reduction of the opening area of the high-pressure communication passage when the pressure within the zone under lower pressure is below the predetermined value. According to the present invention, there is provided another variable capacity vane compressor comprising: a cylinder formed of a cam ring and a pair of front and rear side blocks closing opposite ends of the cam ring, one of the front and rear side blocks having at least one first inlet port formed therein; a rotor rotatably received within the cylinder; a plurality of vanes radially slidably fitted in respective slits formed in the rotor; vane back-pressure chambers defined in the rotor at inner ends of respective ones of the slits, whereby during rotation of the compressor the vanes are moved radially outwardly of the rotor by pressure within respective ones of the vane back-pressure chambers and a centrifugal force caused by the rotation of the rotor; a housing accommodating the cylinder and defining a suction chamber and a discharge pressure chamber therein; wherein compression chambers are defined between the cylinder, the rotor and adjacent ones of the vanes and vary in volume with rotation of the rotor for effecting suction of a compression medium from the suction chamber into the compression chambers through the at least one first inlet port, and compression and discharge of the compression medium; at least one second inlet port formed in the one of the front and rear side blocks which has the at least one first inlet port formed therein, the at least one second inlet port being located adjacent a corresponding one of the at least one first inlet port, and communicating the suction chamber with at least one of the compression chambers which is on a suction stroke; a pressure chamber formed in the one of the front and rear side blocks having the at least one first inlet port formed therein, and communicating a zone under lower pressure with a zone under higher pressure, the lower pressure being variable in response to the rotational speed of the compressor; control means for controlling the opening angle of the at least one second inlet port, the control means having a pressure receiving portion slidably fitted in the pressure chamber and dividing the pressure chamber into a first pressure chamber communicating with the zone under lower pressure and a second pressure chamber communicating with both the zone under lower pressure and the zone under higher pressure; the conrol means being angularly displaceable in response to a difference between the first and second pressure chambers for causing the control means to vary the opening angle of the at least one second inlet port, to thereby cause a change in the timing of commencement of the compression of the compression medium and hence vary the capacity of the compressor; a first communication passage communicating the second pressure chamber with the zone under lower pressure; a second communication passage communicating the second pressure chamber with the zone under higher pressure; a third communication passage communicating the vane back-pressure chambers with the zone under higher pressure; and valve means for selectively opening and closing the first through third communication passages, the valve means being disposed to close the first and third communication passages and simultaneously open the second communication passage when pressure within the zone under lower pressure exceeds a predetermined value, and to open the first and third communication passages and simultaneously close the second communication passage when the pressure within the zone under lower pressure is below the predetermined value.

The above and other objects, features and advantages of the invention will be more apparent from the ensuing detailed description taken in conjunction with the accompanying drawings.

DETAILED DECRIPTION

Figure 1:
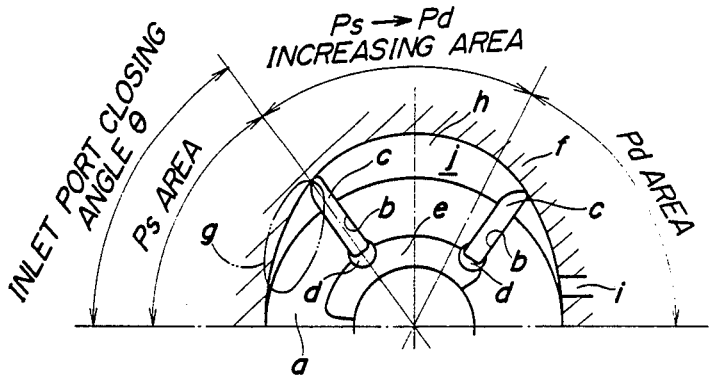
FIG. 1 PRIOR ART
FIG. 1 is a view useful in explaining operating regions which the vane passes to execute one operating cycle of a conventional vane compressor in which a refrigerant inlet port is closed at a fixed angle.
Figure 2:
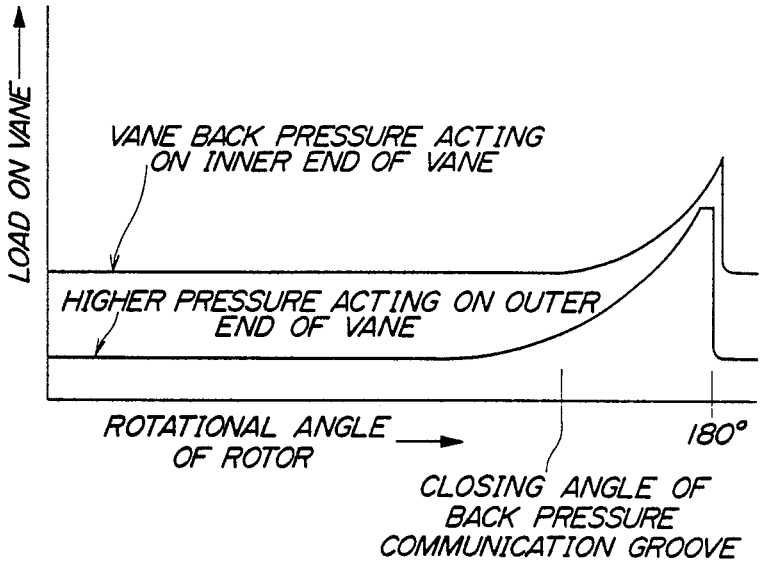
FIG. 2 PRIOR ART
FIG. 2 is a graph showing variations in load on the vane with respect to rotational angle of the rotor of the compressor of FIG. 1.
Figure 3:
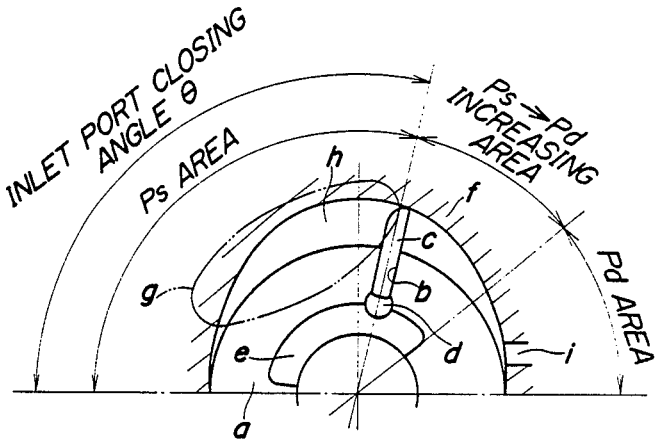
FIG. 3 PRIOR ART
FIG. 3 is a view useful in explaining operating regions which the vane passes to execute one operating cycle of a conventional variable capacity vane compressor.
Figure 4:
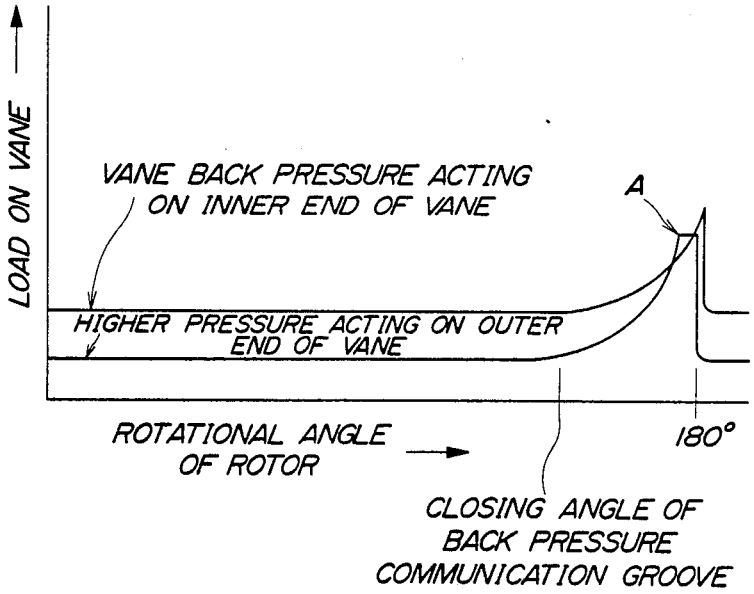
FIG. 4 PRIOR ART
FIG. 4 is a graph showing variations in load on the vane with respect to rotational angle of the rotor during partial capacity operation of the compressor of FIG. 3.

The invention will now be described in detail with reference to the drawings showing embodiments thereof.

FIGS. 5 through 11 show a variable capacity vane compressor according to a first embodiment of the invention, wherein a housing 1 comprises a cylindrical casing 2 with an open end, and a rear head 3, which is fastened to the casing 2 by means of bolts, not shown, in a manner closing the open end of the casing 2. A discharge port 4, through which a refrigerant gas is to be discharged as a thermal medium, is formed in an upper wall of the casing 2 at a front end thereof, and a suction port 5, through which the refrigerant gas is to be drawn into the compressor, is formed in an upper portion of the rear head 3. The discharge port 4 and the suction port 5 communicate, respectively, with a discharge pressure chamber and a suction chamber, both hereinafter referred to.

A pump body 6 is housed in the housing 1. The pump body 6 is composed mainly of a cylinder formed by a cam ring 7, and a front side block 8 and a rear side block 9 closing open opposite ends of the cam ring 7, a cylindrical rotor 10 rotatably received within the cam ring 7, and a driving shaft 11 which is connected to an engine, not shown, of a vehicle or the like, and on which is secured the rotor 10. The driving shaft 11 is rotatably supported by a pair of radial bearings 12 provided in the side blocks 8 and 9, respectively. The driving shaft 11 extends through the front side block 8 and the front head 3 while being sealed in an airtight manner against the interior of the compressor by means of a mechanical sealing device 46 provided around the shaft 11 in the front head 3.

Figure 6:
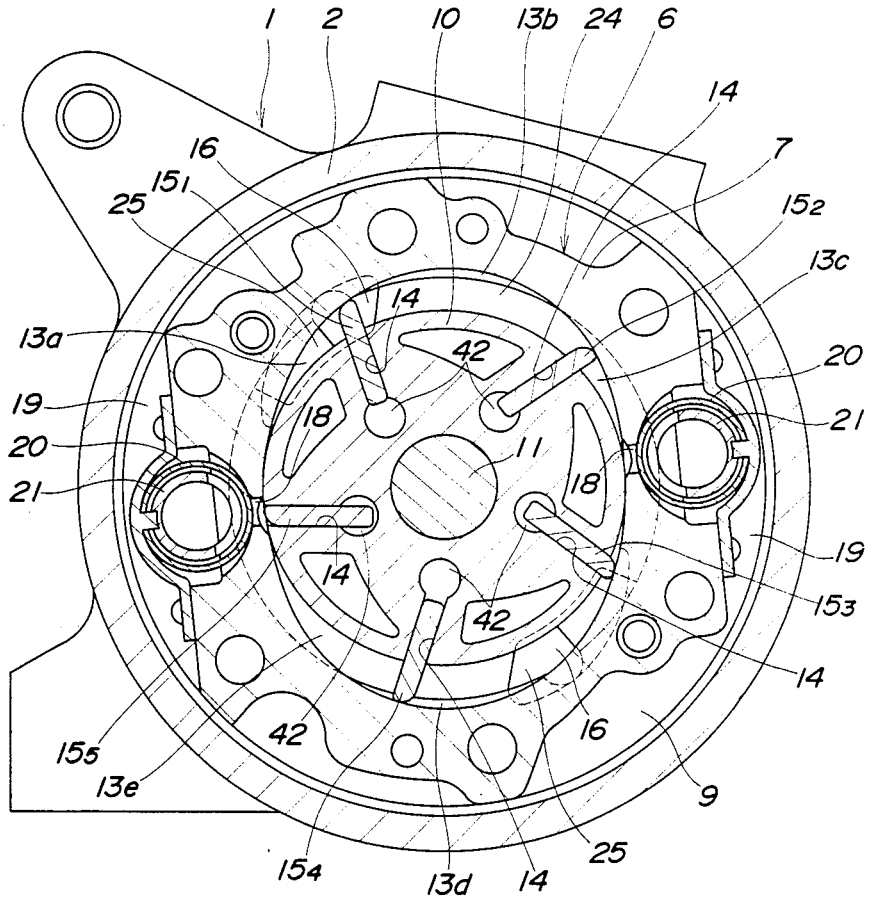
FIG. 6 is a transverse sectional view taken along line VI—VI in FIG. 5.

The cam ring 7 has an inner peripheral surface 7*a* with an elliptical cross section, as shown in FIG. 6, and cooperates with the rotor 10 to define therebetween a pair of spaces 13 and 13 at diametrically opposite locations.

The rotor 10 has its outer peripheral surface formed with a plurality of (five in the illustrated embodiment) axial vane slits 14 at circumferentially equal intervals, in each of which a vane $15_1$–$15_5$ is radially slidably fitted. Adjacent vanes $15_1$–$15_5$ define therebetween five compression chambers 13*a*–13*e* in cooperation with the cam ring 7, the rotor 10, and the opposite inner end faces of the front and rear side blocks 8, 9.

Figure 7:
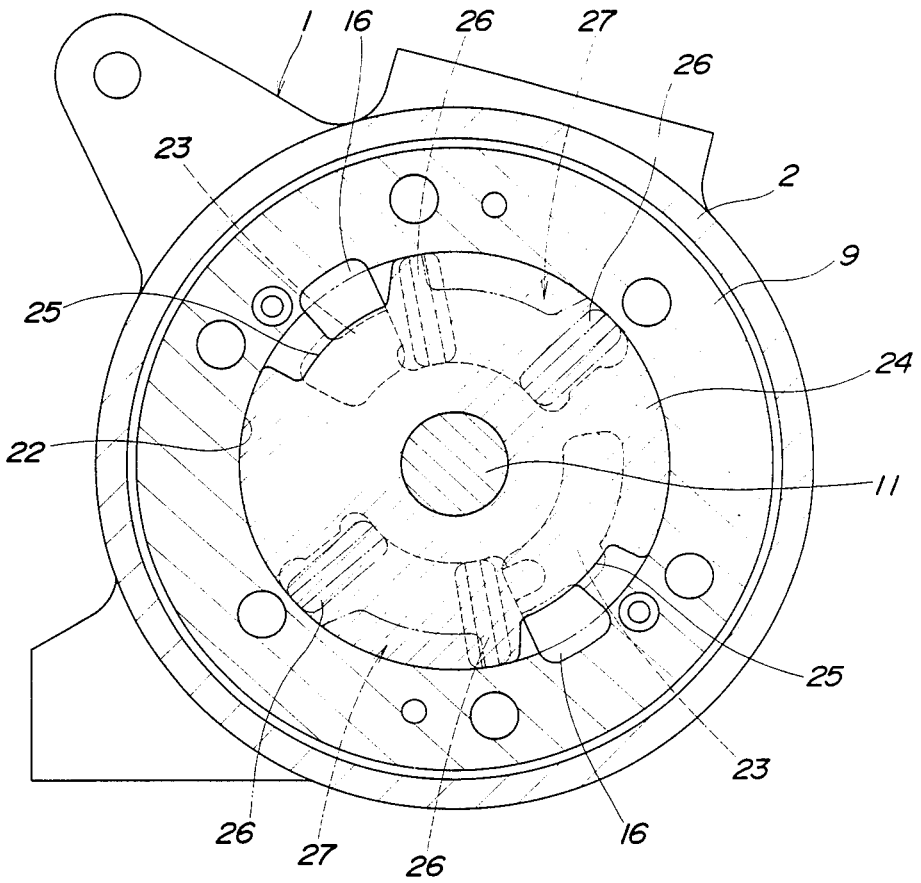
FIG. 7 is a transverse sectional view taken along line VII—VII in FIG. 5.

Refrigerant inlet ports 16 and 16 are formed in the rear side block 9 at diametrically opposite locations as shown in FIGS. 6 and 7. These refrigerant inlet ports 16, 16 are located at such locations that they become closed when the respective compression chambers 13*a*–13*e* assume the maximum volume. These refrigerant inlet ports 16, 16 axially extend through the rear side block 9 and through which a suction chamber (lower pressure chamber) 17 defined in the rear head 3 by the rear side block 9 and the space 13 or compression chamber 13*a* on the suction stroke are communicated with each other.

Figure 5:
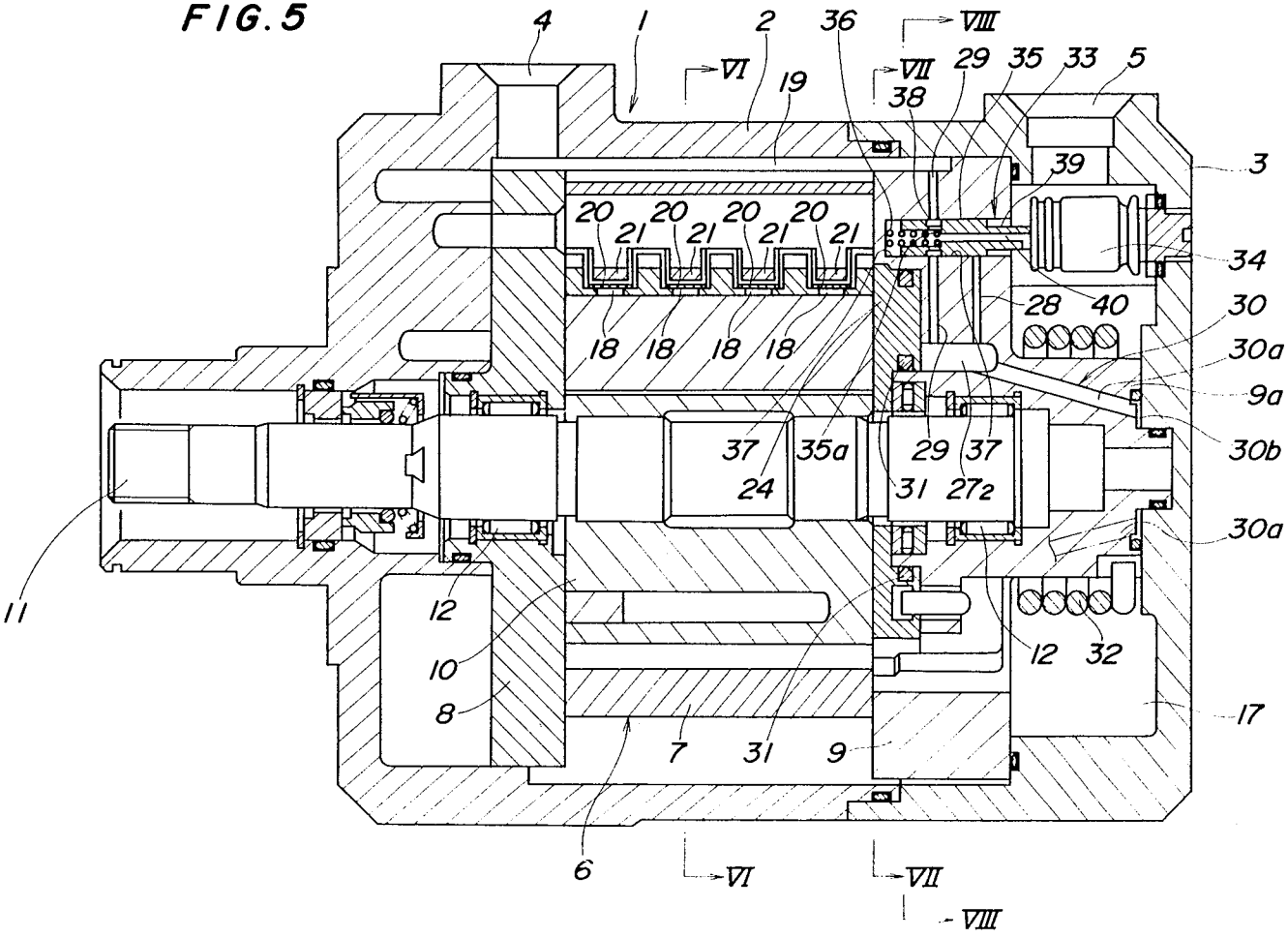
FIG. 5 is a longitudinal sectional view of a variable capacity vane compressor according to a first embodiment of the invention.

Refrigerant outlet ports 18 are formed through opposite lateral side walls of the cam ring 7 and through which spaces 13 or compression chambers 13*c* and 13*e* on the discharge stroke are communicated with the discharge pressure chamber (higher pressure chamber) 19 defined within the casing 2, as shown in FIGS. 5 and 6. These refrigerant outlet ports 18 are provided with respective discharge valves 20 and valve retainers 21, as shown in FIG. 6.

Figure 8:
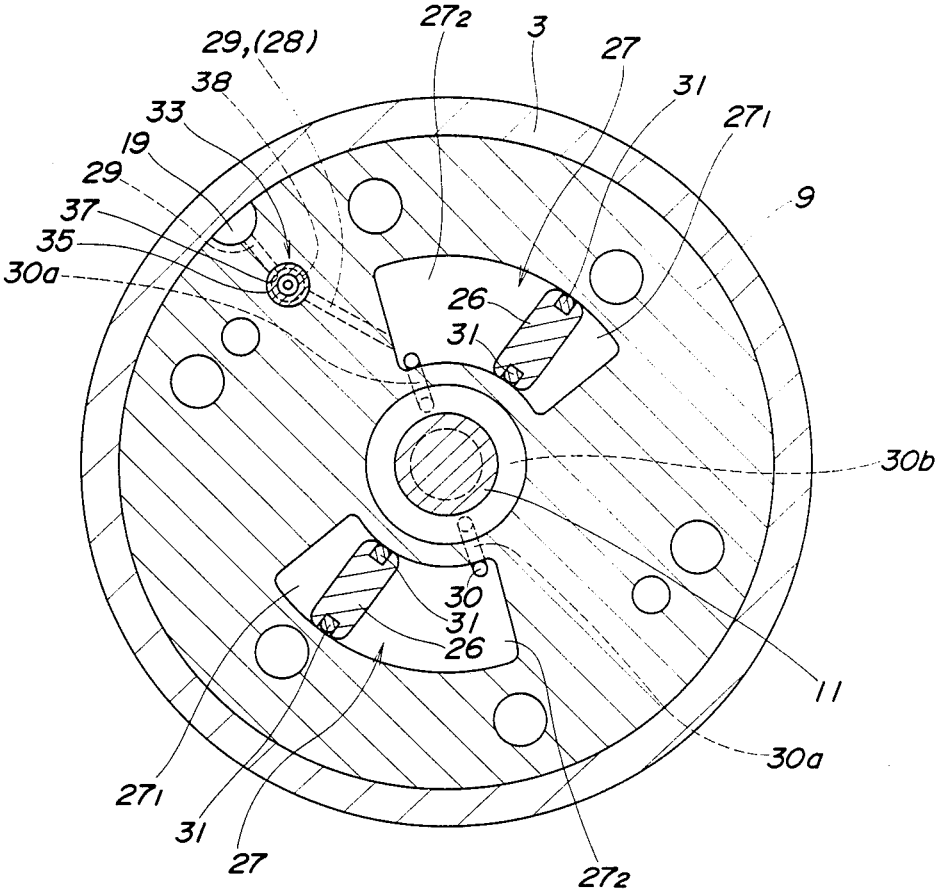
FIG. 8 is a transverse sectional view taken along line VIII—VIII in FIG. 5.
Figure 9:
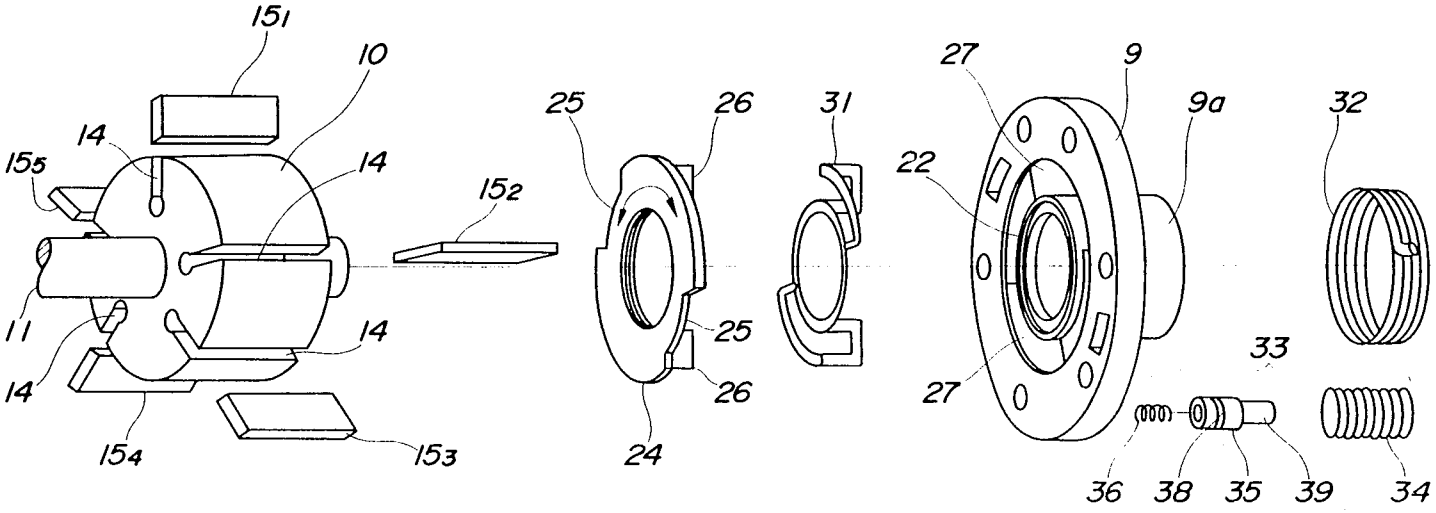
FIG. 9 is an exploded perspective view showing essential parts of the vane compressor of FIG. 5.

The rear side block 9 has an end face facing the rotor 10, in which is formed an annular recess 22 larger in diameter than the rotor 10, as shown in FIGS. 7 and 9. Due to the presence of the annular recess 22, no part of the end face of the rotor 10 facing the rear side block 9 is in contact with the opposed end face of the latter. A pair of second inlet ports 23 and 23 in the form of arcuate openings are formed in the rear side block 9 at diametrically opposite locations and circumferentially extend continuously with the annular recess 22 along its outer periphery, as best shown in FIG. 7, and through which the suction chamber 17 is communicated with the compression chamber 13*a* on the suction stroke. An annular control element 24 is received in the annular recess 22 for rotation in opposite circumferential directions to control the opening angle of the second inlet ports 23, 23. The control element 24 has its outer peripheral edge formed with a pair of diametrically opposite arcuate cut-out portions 25 and 25, and its one side surface formed integrally with a pair of diametrically opposite partition plates 26 and 26 axially projected therefrom and acting as pressure-receiving elements. The partition plates 26, 26 are slidably received in respective arcuate spaces 27 and 27 which are formed in the rear side block 9 in a manner continuous with the annular recess 22 and circumferentially partially overlapping with the respective second inlet ports 23, 23. The interior of each of the arcuate spaces 27, 27 is divided into first and second pressure chambers $27_1$ and $27_2$ by the associated partition plate 26. The first pressure chamber $27_1$ communicates with the suction chamber 17 through the corresponding inlet port 16 and the corresponding second inlet port 23, and the second pressure chamber $27_2$ communicates with the discharge pressure chamber 19 and the suction chamber 17 through a low-pressure passage 28 and a high-pressure passage 29 formed in the rear side block 9, as shown in FIGS. 5 and 8. The two chambers $27_2$, $27_2$ are communicated with each other by way of a communication passage 30. The communication passage 30 comprises a pair of communication channels 30*a*, 30*a* formed in a boss 9*a* projected from a central portion of the rear side block 9 at a side remote from the rotor 10, and an annual space 30*b* defined between a projected end face of the boss 9*a* and an inner end face of the rear head 3, as shown in FIGS. 5 and 8. The communication passages 30*a*, 30*a* are arranged symmetrically with respect to the center of the boss 9*a*. Respective ends of the communication passages 30*a*, 30*a* are communicated with the respective second pressure chambers $27_2$, $27_2$, and the other respective ends are communicated with the annual space 30*b*.

Since the communication passage 30 is provided in the rear side block 9 as a stationary member, as described above, the operation of boring the passage 30 is easier to perform as compared with an arrangement that the communication passage 30 is provided in the control element 24 as a rotatable member. Moreover, since the communication passages 30*a*, 30*a* each have its both ends opening into the corresponding spaces $27_2$, 30*b*, it is positively remove foreign matters such as chips produced by the boring operation, whereby the compressor can be operated with high reliability. That is, if the communication passage 30 is formed in the control element 24, it is necessary to form in the control element two oblique holes crossing with each other and fit blank pins in respective open ends of the oblique holes, which makes it difficult to remove the boring chips.

A sealing member 31 of a special configuration as shown in FIG. 9 is mounted in the control element 24 and disposed along an end face of its central portion and radially opposite end faces of each pressure-receiving protuberance 26, to seal in an airtight manner between the first and second pressure chambers $27_1$ and $27_2$, as well as between the end face of the central portion of the control element 24 and the inner peripheral edge of the annular recess 22 of the rear side block 9, as shown in FIG. 5.

The control element 24 is elastically urged in such a circumferential direction as to increase the opening angle of the second inlet ports 23, i.e. in the counter-clockwise direction as viewed in FIG. 7, by a coiled spring 32 fitted around a central boss 9*a* of the front side block 9 axially extending toward the suction chamber 17, with its one end engaged by the central boss 9*a* and the other end by the control element 24, respectively.

Arranged across the low-pressure and the high-pressure communication passages 28, 29 is a control valve device 33 for selectively closing and opening them, as shown e.g. in FIG. 5. The control valve device 33 is operable in response to pressure within the suction chamber 17, and as shown in FIGS. 5 and 9 it comprises a flexible bellows 34 disposed in the suction chamber 17, with its axis extending parallel with that of the driving shaft 11, a spool valve body 35, and a coiled spring 36 urging the spool valve body 35 in its closing direction. When the suction pressure within the suction chamber 17 is above a predetermined value, the bellows 34 is in a contracted state, while when the suction pressure is below the predetermined value, the bellows 34 is in an expanded state. The spool valve body 35 is slidably fitted in a valve bore 37 formed in the rear side block 9 and extending across the low-pressure communication passage 28 and the high-pressure communication passage 29. The spool valve body 35 has an annular groove 38 formed in its outer peripheral surface closer to an end remote from the bellows 34, and has a thinned end portion 39 with a small diameter substantially equal to the inner diameter of the annular groove 38 at a location closer to the bellows 34. The spool valve body 35 also has an axial internal passage 40 formed therethrough along its axis. The coiled spring 36 is interposed between a seating surface 35*a* formed in an end face of the spool valve body 35 remote from the bellows 34 and an opposed end face of the valve bore 37. The other end face of the spool valve body 35 is in urging contact with an opposed end face of the bellows 34. When the pressure within the suction chamber 17 is above the predetermined value and the bellows 34 is contracted, the annular groove 38 of the spool valve body 35 is aligned with the high-pressure communication passage 29 to open the passage 29, and at the same time the low-pressure communication passage 28 is blocked by the peripheral wall of the spool valve body 35. When the pressure within the suction chamber 17 is less than the predetermined value and the bellows 34 is expanded, the high-pressure communication passage 29 is blocked by the peripheral wall of the spool valve body 35, and at the same time the low-pressure communication passage 28 is aligned with the thinned portion 39 of the spool valve body 35 to open the low-pressure communication passage 28. The pressure within the suction chamber 17 acts on the end face of the spool valve body 35 close to the coiled spring 36 by way of the passage 40, as well as on the other end face of the spool valve body 35. Therefore, the spool valve body 35 is only subject to sliding friction during the displacement thereof, thereby undergoing a very small hysteresis between the time of movement in one direction and that in the opposite direction. Further, the spool valve body 35 and the bellows 34 are separably in contact with each other, there being no fear of breakage of them due to vibration or the like.

Although, in the illustrated embodiment, the low-pressure communication passage 28 is opened and simultaneously the high-pressure communication passage 29 is closed, and vice versa, it may be so arranged that the high-pressure communication passage 29 is opened with a time lag after the low-pressure communication passage 28 is closed when the pressure within the suction chamber 17 rises above the predetermined value, and/or the low-pressure communication passage 28 is opened with a time lag after the high-pressure communication passage 29 is closed when the pressure within the suction chamber 17 drops below the predetermined value. To this end, in FIGS. 10 and 11, if the high-pressure communication passage 29 is formed at a location indicated by the one-dot chain lines, for instance, the spool valve body 35 opens the high-pressure communication passage 29 after it closes the low-pressure communication passage 28 when the compressor is brought into low speed operation to cause the bellows 34 to be contracted, while the spool valve body 35 opens the low-pressure communication passage 28 after it closes the high-pressure communication passage 29 when the compressor is brought into high speed operation to cause the bellows 34 to be expanded.

Further, it may be so arranged that the opening area of the high-pressure communication passage 29 is reduced, in stead of being fully closed as shown in the above first embodiment. For instance, if the high-pressure communication passage 29 is formed at a location and with a size indicated by the two-dot chain lines in FIGS. 10 and 11, the spool vavle body 35 opens the low-pressure communication passage 28 and simultaneously reduces the opening area of the high-pressure communication passage 29 when the compressor is brought into high speed operation to cause the bellows 34 to be expanded.

The operation of the first embodiment of the invention will now be explained.

As the driving shaft 11 is rotatively driven by a prime mover such as an automotive engine to cause clockwise rotation of the rotor 10 as viewed in FIG. 6, the rotor 10 rotates so that the vanes $15_1$–$15_5$ successively move radially out of the respective slits 14 due to a centrifugal force and back pressure acting upon the vanes and revolve together with the rotating rotor 10, with their tips in sliding contact with the inner peripheral surface of the cam ring 7. During the suction stroke the compression chamber 13*a* defined by adjacent vanes increases in volume so that refrigerant gas as thermal medium is drawn through the refrigerant inlet port 16 into the compression chamber 13*a*; during the following compression stroke the compression chamber 13*c*, 13*e* decreases in volume to cause the drawn refrigerant gas to be compressed; and during the discharge stroke at the end of the compression stroke the high pressure of the compressed gas forces the discharge valve 20 to open to allow the compressed refrigerant gas to be discharged through the refrigerant outlet port 18 into the discharge pressure chamber 19 and then discharged through the discharge port 4 into a heat exchange circuit of an associated air conditioning system, not shown.

During the operation of the compressor described above, low pressure or suction pressure within the suction chamber 17 is introduced into the first pressure chamber $27_1$ of each space 27 through the refrigerant inlet port 16, whereas high pressure or discharge pressure within the discharge pressure chamber 19 is introduced into the second pressure chamber $27_2$ of each space 27 through the high-pressure communication passage 29 or through both the high-pressure communication passage 29 and the communication passage 30. The control element 24 is circumferentially displaced depending upon the difference between the sum of the pressure within the first pressure chamber $27_1$ and the biasing force of the coiled spring 32 (which acts upon the control element 24 in the direction of the opening angle of each second inlet port 23 being increased, i.e. in the counter-clockwise direction as viewed in FIG. 7) and the pressure within the second pressure chamber $27_2$ (which acts upon the control element 24 in the direction in which the above opening angle is decreased, i.e. in the clockwise direction as viewed in FIG. 7), to vary the opening angle of each second inlet port 23 and accordingly vary the timing of commencement of the compression stroke and hence the delivery quantity. When the above difference becomes zero, that is, when the sum of the pressure within the first pressure chamber $27_1$ and the biasing force of the spring 32 becomes balanced with the pressure within the second pressure chamber $27_2$, the circumferential displacement of the control element 24 stops.

Figure 10:
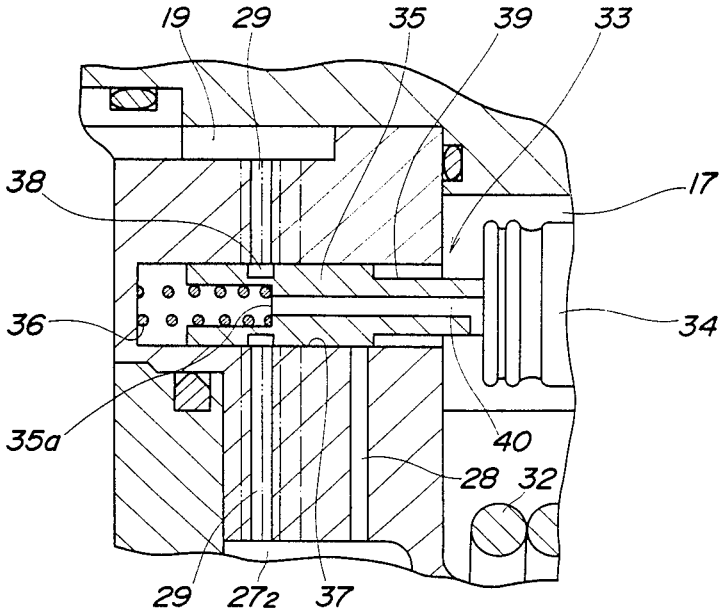
FIG. 10 is an enlarged longitudinal sectional view of a valve control device in a position assumed when the vane compressor in FIG. 5 is at full capacity operation.

For instance, when the compressor is operating at a low speed, the refrigerant gas pressure or suction pressure within the suction chamber 17 is so high that the bellows 34 of the control valve device 33 is contracted to bias the spool valve body 35 to open the high-pressure communication passage 29 and simultaneously block the low-pressure communication passage 28, as shown in FIG. 10. Accordingly, the pressure within the discharge pressure chamber 19 is introduced into the second pressure chamber $27_2$. Thus, the pressure within the second pressure chamber $27_2$ surpasses the sum of the pressure within the first pressure chamber $27_1$ and the biasing force of the coiled spring 32 so that the control element 24 is circumferentially displaced into an extreme position in the clockwise direction as viewed in FIG. 7, whereby the second inlet ports 23, 23 are fully closed by the control element 24 as indicated by the two-dot chain lines in FIG. 7 (the opening angle is zero). Consequently, all the refrigerant gas drawn through the refrigerant inlet port 16 into the compression chamber 13*a* on the suction stroke is compressed and discharged, resulting in the maximum delivery quantity (Full Capacity Operation).

Figure 11:
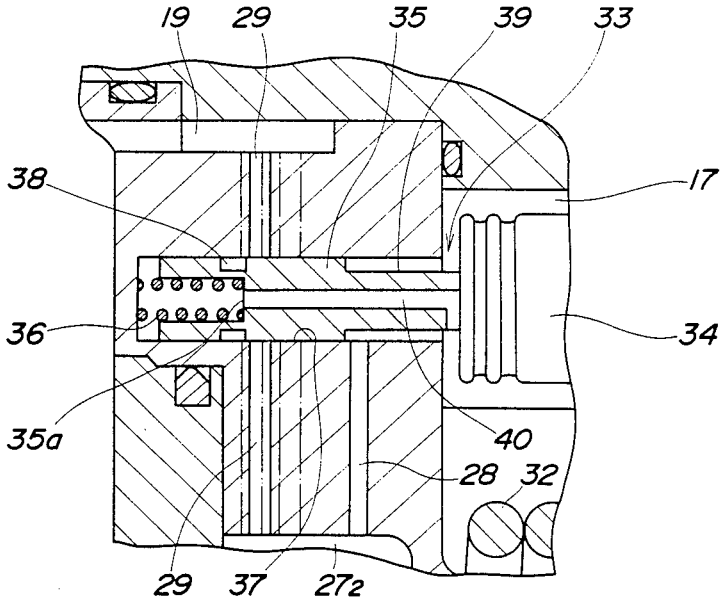
FIG. 11 is a view similar to FIG. 10, wherein the valve control device is in a position assumed when the vane compressor in FIG. 5 is at partial capacity operation.
Figure 12:
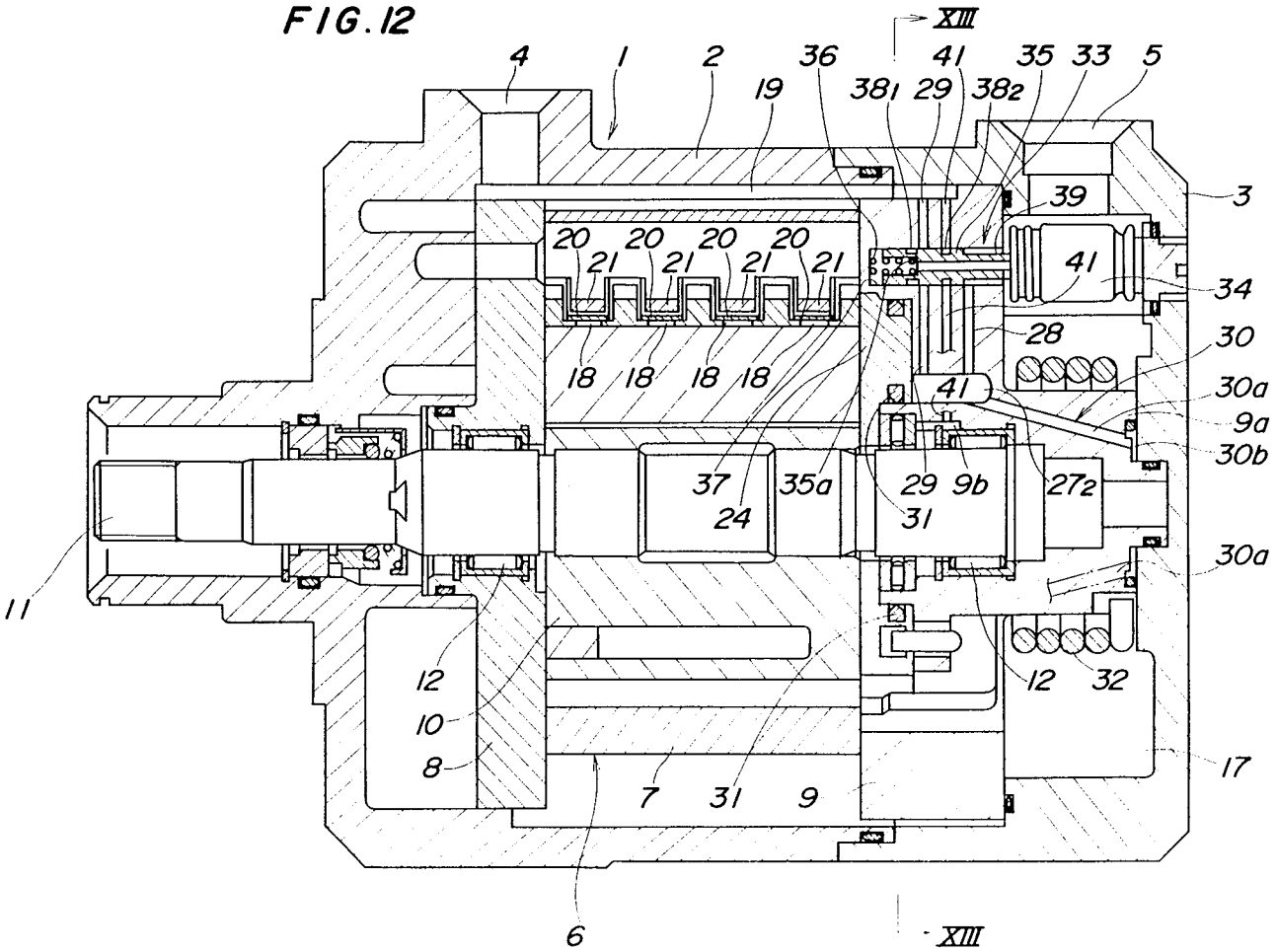
FIG. 12 is a longitudinal sectional view of a variable capacity vane compressor according to a second embodiment of the invention.
Figure 13:
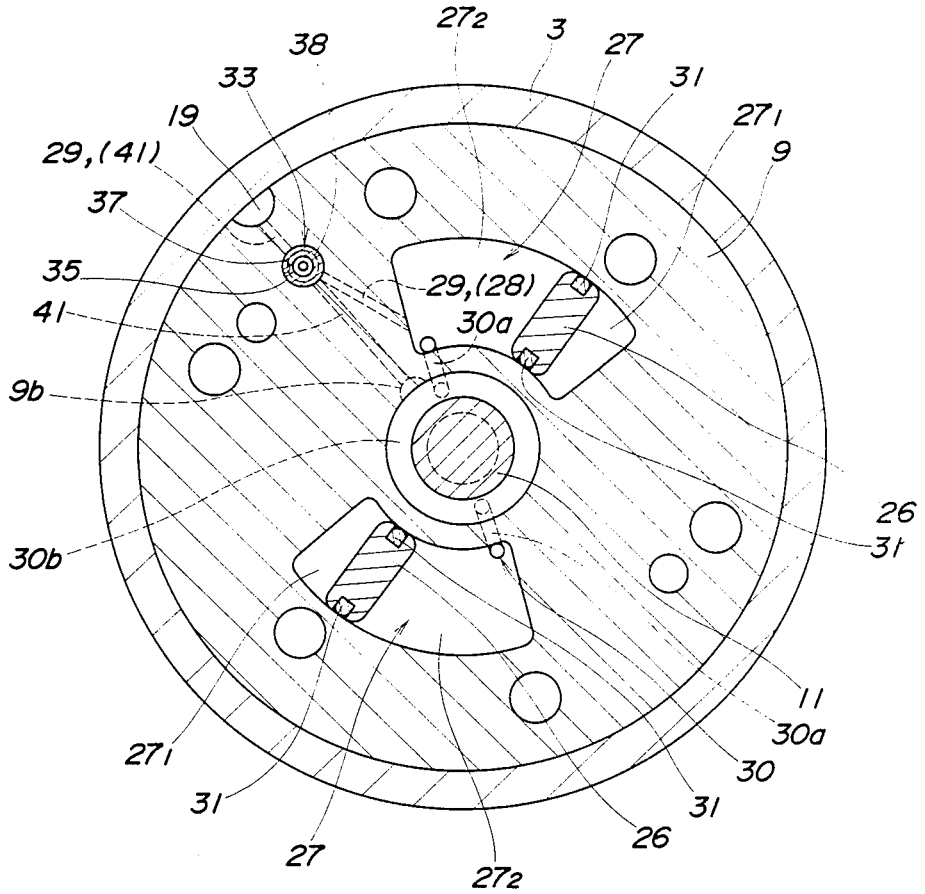
FIG. 13 is a transverse sectional view taken along line XIII—XIII in FIG. 12.

On the other hand, when the compressor is brought into high speed operation, the suction pressure within the suction chamber 17 is so low that the bellows 34 of the control valve 33 is expanded to urgingly bias the spool valve body 35 against the urging force of the spring 36 to open the low-pressure communication passage 28 and simultaneously block the high-pressure communication passage 29, as shown in FIG. 11. Accordingly, the pressure within the discharge pressure chamber 19 is not introduced into the second pressure chamber $27_2$, and at the same time the pressure within the second pressure chamber $27_2$ leaks through the low-pressure communication passage 28 into the suction chamber 17 in which low or suction pressure prevails to cause a prompt drop in the pressure within the second pressure chamber $27_2$. As a result, the control element 24 is promptly angularly or circumferentially displaced in the counter-clockwise direction as viewed in FIG. 7. When the cut-out portions 25, 25 of the control element 24 thus become aligned with the respective second inlet ports 23, 23 to open the latter, as indicated by the solid lines in FIG. 7, refrigerant gas in the suction chamber 17 is drawn into the compression chambers 13*a* not only through the refrigerant inlet ports 16, 16 but also through the second inlet ports 23, 23. Therefore, the timing of commencement of the compression stroke is retarded by an amount corresponding to the degree of opening of the second inlet ports 23, 23 so that the compression stroke period is reduced, resulting in a reduced amount of refrigerant gas that is compressed and hence a reduced delivery quantity (Partial Capacity Operation).

As described above, according to the first embodiment of the present invention, since the control element is controlled by the pressure within the compressor, the compressor can be simple in construction and compact in size, thus facilitating assemblage of the compressor and reducing the manufacturing cost. Further, according to the first embodiment of the invention, when the discharge capacity of the compressor is to be changed from a greater value to a smaller value, the high pressure within the supply of high pressure into the second pressure chamber is interrupted and simultaneously the pressure within the second pressure chamber is allowed to leak into the low-pressure zone or suction chamber, whereby the compressor capacity can be varied with high responsiveness and controlled with high reliability. Furthermore, the pressure chambers form part of the passageway for relieving the high pressure into the low pressure zone, thus enabling to make the capacity control machanism more compact in size, which is advantageous to a compressor of this kind which generally undergoes limitations in mounting space.

FIGS. 12 through 16 show a second embodiment of the invention. The second embodiment is distinguished from the first embodiment described above in that the discharge pressure chamber 19 is communicated with the vane back-pressure chambers 42 through a communication passage 41.

In FIGS. 12 through 15, corresponding or similar elements or parts to those in FIGS. 5 through 11 are designated by identical reference numerals, and detailed description thereof is omitted. FIGS. 6 and 7 showing the first embodiment are also applied to the second embodiment.

In the variable capacity vane compressor according to the second embodiment, similarly to the first embodiment, the first pressiure chambers $27_1$ are communicated with the suction chamber 17 through respective inlet ports 16 and second inlet ports 23, while the second pressure chambers $27_2$ are each communicated with the suction chamber 17 and the discharge pressure chamber 19 through a first communication passage 28 (low-pressure communication passage) and a second communication passage 29 (high-pressure communication passage) or through the first and second communication passages 28, 29 and the communicaiton passage 30. The discharge pressure chamber 19 is communicated through the third communication passage 41 with a notched recess 9*b* formed in an inner peripheral surface of a bore formed in the rear side block 9 in which the bearing 12 is fitted, the notched recess 9*b* being communicated with each vane back-pressure chamber 42 defined in the rotor at an inner end of each vane slit 14, as shown in FIG. 6. The third communication passage 41 is formed in the rear side block 9 and extends between the first communication passage 28 and the second communication passage 29.

A control valve device 33, which is similar in construction to that of the first embodiment, which is provided for selectively opening and closing the first through third communication passages 28, 29, and 41.

The control valve device 33 has a spool valve body 35 slidably fitted through a valve bore 37 formed in the rear side block 9 across the communication passages 8, 29, and 41. The control valve device 33 and the communication passages 28, 29, and 41 are so arranged relative to each other that when the pressure within the suction chamber 17 is higher than a predetermined value to cause the bellows 34 to be contracted, a first annular groove $38_1$ formed in the spool valve body 35 is aligned with the second communication passage 29 to open the passage 29, while the first communication passage 28 and third communication passage 41 are blocked by the peripheral wall of the spool valve body 35. When the pressure within the suction chamber 17 is lower than the predetermined value to cause the bellows to be expanded, the second communication passage 29 is out of alignment with the first annular groove $38_1$ and blocked by the peripheral wall of the spool valve body 35, and at the same time the first communication passage 28 and the third communication passage 41 are aligned with a thinned end portion 39 with a small diameter of the spool valve body 35 and a second annular groove $38_2$ formed in the spool valve body 35, respectively, to therby open the first and third communication passages 28, 41 are opened.

The second communication passage 29 may have its opening area reduced instead of being fully closed, when the pressure within the suction chamber 17 is below the predetermined value, like the first embodiment indicated by the two-dot chain lines in FIG. 11.

The vane compressor according to the second embodiment constructed as above operates as follows.

Figure 14:
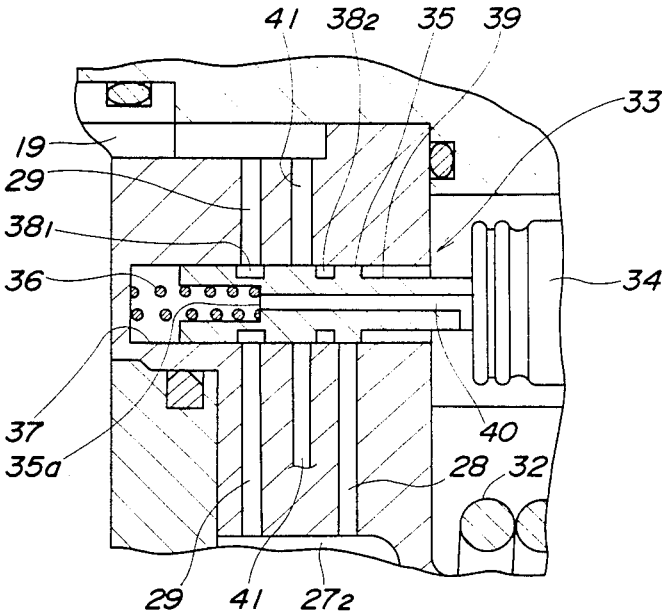
FIG. 14 is an enlarged longitudinal sectional view of a valve control device in a position assumed when the vane compressor in FIG. 12 is at full capacity operation.

When the compressor is operating at a low speed, the refrigerant gas pressure or suction pressure within the suction chamber 17 is so high that the bellows 34 of the control valve device 33 is contracted to bias the spool valve body 35 to open the second communication passage 29 and simultaneously block the first and third communication passages 28, 41, as shown in FIG. 14. Accordingly, the pressure within the discharge pressure chamber 19 is introduced into the second pressure chamber $27_2$ through the passage 29, and the pressure within the second pressure chamber $27_2$ surpasses the sum of the pressure within the first pressure chamber $27_1$ and the biasing force of the coiled spring 32 so that the control element 24 is circumferentially displaced into an extreme position in the clockwise direction as viewed in FIG. 7, whereby the second inlet ports 23, 23 are fully closed by the control element 24 as indicated by the two-dot chain lines in FIG. 7 (the opening angle is zero). Consequently, all the refrigerant gas drawn through the refrigerant inlet port 16 into the compression chamber 13*c*, 13*e* on the suction stroke is compressed and discharged, resulting in the maximum delivery quantity (Full Capacity Operation).

Figure 15:
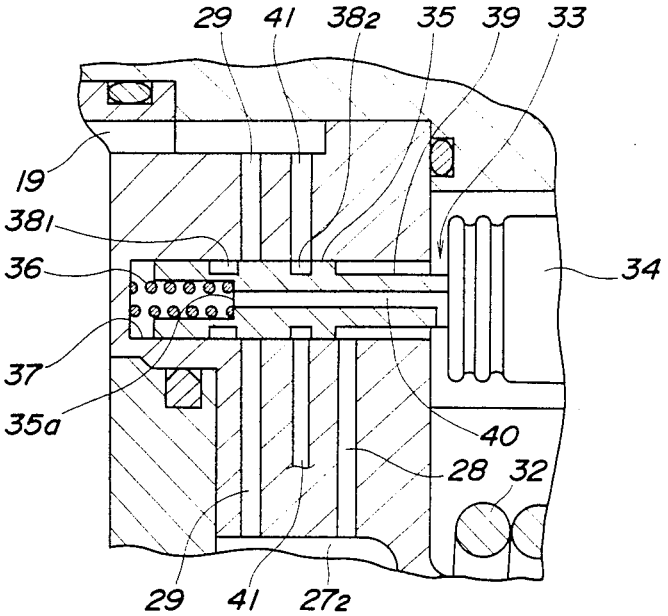
FIG. 15 is a view similar to FIG. 14, wherein the valve control device is in a position assumed when the vane compressor in FIG. 12 is at partial capacity operation.
Figure 16:
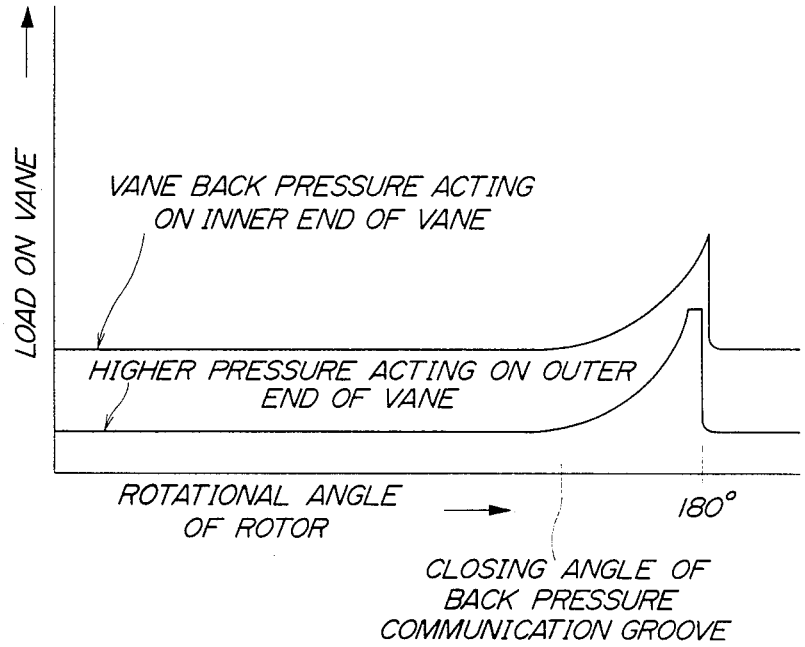
FIG. 16 is a graph showing variations in load on the vane with respect to rotation of the rotor when the vane compressor according to the second embodiment is at partial capacity operation.

On the other hand, when the compressor is brought into high speed operation, the suction pressure within the suction chamber 17 is so low that the bellows 34 of the control valve 33 is expanded to urgingly bias the spool valve body 35 against the urging force of the spring 36 to open the first and third communication passages 28, 41 and simultaneously block the second communication passage 29, as shown in FIG. 15. Accordingly, the pressure within the discharge pressure chamber 19 is not introduced into the second pressure chamber $27_2$, and at the same time the pressure within the second pressure chamber $27_2$ leaks through the first communication passage 28 into the suction chamber 17 in which low or suction pressure prevails to cause a prompt drop in the pressure within the second pressure chamber $27_2$. As a result, the control element 24 is angularly or circumferentially displaced, in a prompt manner, in the counterclockwise direction as viewed in FIG. 7. When the cut-out portions 25, 25 of the control element 24 thus become aligned with the respective second inlet ports 23, 23 to open the latter, as indicated by the solid lines in FIG. 7, refrigerant gas in the suction chamber 17 is drawn into the compression chamber 13*a* not only through the refrigerant inlet ports 16, 16 but also through the second inlet ports 23, 23. Therefore, the timing of commencement of the compression stroke is retarded by an amount corresponding to the degree of opening of the second inlet ports 23, 23 so that the compression stroke period is reduced, resulting in a reduced amount of refrigerant gas that is compressed and hence a reduced delivery quantity (Partial Capacity Operation).

Since the third communication passage 41 is opened during the partial capacity operation, as described above, the high pressure within the discharge pressure chamber 19 is introduced into the vane back-pressure chamber 42 by way of the third communication passage 41 and the notched recess 9*b*, thereby increasing the vane back pressure Pk. Therefore, the vane back pressure applied to the respective inner ends of the vanes $15_1$–$15_5$ is always larger than the high pressure applied to the respective outer ends of the vanes $15_1$–$15_5$, during both the full capacity operation and the partial capacity operation, so that the respective outer ends of the vanes $15_1$–$15_5$ are kept in contact with the inner peripheral surface of the cam ring 7.

Therefore, according to the second embodiment of the invention, in addition to similar results to those of the first embodiment stated before, there occurs no chattering noise during partial capacity operation of the compressor since the high pressure is introduced into the vane back-pressure chamber to increase the back pressure, which prevents the outer ends of the vanes from becoming out of contact with the inner peripheral surface of the cam ring.

Incidentally, in the foregoing embodiments, the opening angle of the second inlet ports 23, 23 is controlled to a value where the sum of the pressure force within the first pressure chamber $27_1$ and the force of the coiled spring 31 balances with the pressure force within the second pressure chamber $27_2$. The circumferential position of the control element 24 varies in a continuous manner in response to change in the suction pressure within the suction chamber 17. Thus, the delivery quantity or capacity of the compressor is controlled to vary in a continuous manner.

Although in the embodiments the second pressure chamber $27_2$ is supplied with discharge gas pressure from the discharge pressure chamber 19, back pressure acting upon the vanes $15_1$–$15_5$ to urge them in the radially outward direction may be supplied to the second pressure chamber $27_2$, instead of the discharge gas pressure.

What is claimed is:

1. A variable capacity vane compressor comprising: a cylinder formed of a cam ring and a pair of front and rear side blocks closing opposite ends of said cam ring, one of said front and rear side blocks having at least one first inlet port formed therein; a rotor rotatably received within said cylinder; a plurality of vanes radially slidably fitted in respective slits formed in said rotor; a housing accommodating said cylinder and defining a suction chamber and a discharge pressure chamber therein; wherein compression chambers are defined between said cylinder, said rotor and adjacent ones of said vanes and vary in volume with rotation of said rotor for effecting suction of a compression medium from said suction chamber into said compression chambers through said at least one first inlet port, and compression and discharge of said compression medium; at least one second inlet port formed in said one of said front and rear side blocks which has said at least one first inlet port formed therein, said at least one second inlet port being located adjacent a corresponding one of said at least one first inlet port, and communicating said suction chamber with at least one of said compression chambers which is on a suction stroke; a pressure chamber formed in said one of said front and rear side blocks having said at least one first inlet port formed therein, and communicating a zone under lower pressure with a zone under higher pressure, said lower pressure being variable in response to the rotational speed of the compressor; control means for controlling the opening angle of said at least one second inlet port, said control means having a pressure receiving portion slidably fitted in said pressure chamber and dividing said pressure chamber into a first pressure chamber communicating with said zone under lower pressure and a second pressure chamber communicating with both said zone under lower pressure and said zone under higher pressure; said control means being angularly displaceable in response to a difference between said first and second pressure chambers for causing said control means to vary the opening angle of said at least one second inlet port, to thereby cause a change in the timing of commencement of the compression of the compression medium and hence vary the capacity of the compressor; a low-pressure communication passage communicating said second pressure chamber with said zone under lower pressure; a high-pressure communication passage communicating said second pressure chamber with said zone under higher pressure; and valve means for selectively opening and closing said low-pressure communication passage and said high-pressure communication passage, said valve means being disposed to close said low-pressure communication passage and simultaneously open said high-pressure communication passage when pressure within said zone under lower pressure exceeds a predetermined value, and to open said low-pressure communication passage and simultaneously effect one of closing and reduction of the opening area of said high-pressure communication passage when the pressure within said zone under lower pressure is below said predetermined value.

2. A variable capacity vane compressor as claimed in claim 1, wherein said valve means is disposed to close said low-pressure communication passage and simultaneously open said high-pressure communication passage when the pressure within said zone under lower pressure rises above said predetermined value, and to open said low-pressure communication passage and simultaneously effect one of closing and reduction of the opening area of said high-pressure communication passage when the pressure within said zone under lower pressure dropssaid predetermined value.

3. A variable capacity vane compressor as claimed in claim 1, wherein said valve means is disposed to open said high-pressure communication passage with a time lag after said low-pressure communication passage is closed when the pressure within said zone under lower pressure rises above said predetermined value, and to open said low-pressure communication passage with a time lag after said high-pressure communication passage is closed when the pressure within said zone under lower pressure drops below said predetermined value.

4. A variable capacity vane compressor as claimed in claim 1, wherein said valve means is arranged in said one of said side blocks having said at least one first inlet port, and is provided across said low-pressure communication passage and said high-pressure communication passage.

5. A variable capacity vane compressor comprising: a cylinder formed of a cam ring and a pair of front and rear side blocks closing opposite ends of said cam ring, one of said front and rear side blocks having at least one first inlet port formed therein; a rotor rotatably received within said cylinder; a plurality of vanes radially slidably fitted in respective slits formed in said rotor; vane back-pressure chambers defined in said rotor at inner ends of respective ones of said slits, whereby during rotation of the compressor said vanes are moved radially outwardly of said rotor by pressure within respective ones of said vane back-pressure chambers and a centrifugal force caused by the rotation of said rotor; a housing accommodating said cylinder and defining a suction chamber and a discharge pressure chamber therein; wherein compression chambers are defined between said cylinder, said rotor and adjacent ones of said vanes and vary in volume with rotation of said rotor for effecting suction of a compression medium from said suction chamber into said compression chambers through said at least one first inlet port, and compression and discharge of said compression medium; at least one second inlet port formed in said one of said front and rear side blocks which has said at least one first inlet port formed therein, said at least one second inlet port being located adjacent a corresponding one of said at least one first inlet port, and communicating said suction chamber with at least one of said compression chambers which is on a suction stroke; a pressure chamber formed in said one of said front and rear side blocks having said at least one first inlet port formed therein, and communicating a zone under lower pressure with a zone under higher pressure, said lower pressure being variable in response to the rotational speed of the compressor; control means for controlling the opening angle of said at least one second inlet port, said control means having a pressure receiving portion slidably fitted in said pressure chamber and dividing said pressure chamber into a first pressure chamber communicating with said zone under lower pressure and a second pressure chamber communicating with both said zone under lower pressure and said zone under higher pressure; said conrol means being angularly displaceable in response to a difference between said first and second pressure chambers for causing said control means to vary the opening angle of said at least one second inlet port, to thereby cause a change in the timing of commencement of the compression of the compression medium and hence vary the capacity of the compressor; a first communication passage communicating said second pressure chamber with said zone under lower pressure; a second communication passage communicating said second pressure chamber with said zone under higher pressure; a third communication passage communicating said vane back-pressure chambers with said zone under higher pressure; and valve means for selectively opening and closing said first through third communication passages, said valve means being disposed to close said first and third communication passages and simultaneously open said second communication passage when pressure within said zone under lower pressure exceeds a predetermined value, and to open said first and third communication passages and simultaneously close said second communication passage when the pressure within said zone under lower pressure is below said predetermined value.

6. A variable capacity vane compressor as claimed in claim 5, wherein said valve means is arranged in said one of said side blocks having said at least one first inlet port formed therein, and extends across said first through third communication passages.

7. A variable capacity vane compressor as claimed in any of claims 1 through 6, wherein said zone under lower pressure is said suction chamber.

8. A variable capacity vane compressor as claimed in any of claims 1 through 6, wherein said zone under higher pressure is said discharge pressure chamber.

9. A variable capacity vane compressor as claimed in claim 4 or claim 6, wherein said valve means comprises a spool valve body slidably fitted in a valve hole formed in said one of said side blocks having said at least one first inlet port formed therein, spring means arranged at one end of said spool valve body and urging said spool valve body, and a bellows arranged within said suction chamber separably disposed in contact with another end of said spool valve body.

10. A variable capacity vane compressor as claimed in claim 9, wherein said spool valve body has a passage formed therein and axially extending therethrough, said passage communicating with said suction chamber.

* * * * *